US012503917B2

(12) United States Patent
Peters

(10) Patent No.: US 12,503,917 B2
(45) **Date of Patent: *Dec. 23, 2025**

(54) SELF-ALIGNING BEARING ASSEMBLY FOR DOWNHOLE MOTORS

(71) Applicant: Baker Hughes, a GE company, LLC, Houston, TX (US)

(72) Inventor: Volker Peters, Wienhausen (DE)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/385,308

(22) Filed: Oct. 30, 2023

(65) Prior Publication Data

US 2024/0060367 A1 Feb. 22, 2024

Related U.S. Application Data

(63) Continuation of application No. 16/362,349, filed on Mar. 22, 2019, now Pat. No. 11,802,443.

(51) Int. Cl.
*E21B 7/06* (2006.01)
*E21B 4/00* (2006.01)

(52) U.S. Cl.
CPC ..... *E21B 7/067* (2013.01); *E21B 4/003* (2013.01)

(58) Field of Classification Search
CPC ..... E21B 7/06; E21B 4/003
See application file for complete search history.

(56) References Cited

U.S. PATENT DOCUMENTS

| | | | |
|---|---|---|---|
| 7,552,782 B1 | 6/2009 | Sexton et al. | |
| 8,701,797 B2 | 4/2014 | Baudoin | |
| 2005/0098350 A1* | 5/2005 | Eppink | E21B 19/07 175/45 |

(Continued)

FOREIGN PATENT DOCUMENTS

| | | |
|---|---|---|
| CN | 201826772 U | 5/2011 |
| CN | 207813495 U | 9/2018 |

OTHER PUBLICATIONS

Karlsson, H., et al., "Performance Drilling Optimization," SPE/IADC 13474, 1985 Drilling Conference held in New Orleans, Louisiana, Mar. 6-8, 1985.

*Primary Examiner* — Tara Schimpf
*Assistant Examiner* — Lamia Quaim
(74) *Attorney, Agent, or Firm* — Crowe & Dunlevy, P.C.

(57) ABSTRACT

An apparatus for use in a wellbore includes a drill string section, a drive shaft disposed in the drill string section, a bearing assembly connected to the drive shaft, and an alignment assembly connecting the bearing assembly to the drill string section. The alignment assembly has a first alignment member and a second alignment member slidingly engaging one another to allow at least a portion of the bearing assembly to tilt relative to the drill string section. A related method includes the steps of positioning a drive shaft in a drill string section; connecting a bearing assembly to the drive shaft using the alignment assembly, the alignment assembly having a first alignment member and a second alignment member; and allowing at least a portion of the bearing assembly to tilt relative to the drill string section using the alignment assembly by having the first alignment member and the second alignment member slidingly engage one another.

16 Claims, 10 Drawing Sheets

(56) References Cited

U.S. PATENT DOCUMENTS

| | | | | |
|---|---|---|---|---|
| 2012/0285748 | A1 | 11/2012 | Kirkhope | |
| 2013/0319764 | A1* | 12/2013 | Schaaf | E21B 7/068 175/50 |
| 2014/0209389 | A1* | 7/2014 | Sugiura | E21B 7/067 175/73 |
| 2016/0312535 | A1* | 10/2016 | Ritchie | F16C 33/26 |
| 2016/0319601 | A1 | 11/2016 | Bhosle et al. | |
| 2018/0002991 | A1 | 1/2018 | Patwa et al. | |

* cited by examiner

SELF-ALIGNING BEARING ASSEMBLY FOR DOWNHOLE MOTORS

PRIORITY CLAIM

This application is a continuation of and takes priority from U.S. patent application Ser. No. 16/362,349, filed: Mar. 22, 2019, and titled Title: SELF-ALIGNING BEARING ASSEMBLY FOR DOWNHOLE MOTORS, the contents of which are incorporated for all purposes.

BACKGROUND OF THE DISCLOSURE

1. Field of the Disclosure

This disclosure relates generally to oilfield downhole tools and more particularly to bearing assemblies utilized for drilling wellbores.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing". The string comprising the pipe or the tubing and the drilling assembly is usually referred to as the "drill string". When jointed pipe is utilized as the tubing, the drill bit is rotated by rotating the jointed pipe from the earth's surface and/or by a drilling motor such as a mud motor contained in the drilling assembly. In the case of a coiled tubing, the drill bit is rotated by the drilling motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the earth's surface rock pieces disintegrated by the drill bit in drilling the wellbore. The drilling motor is rotated by the drilling fluid passing through the drilling assembly. A drive shaft connected to the motor and the drill bit rotates the drill bit.

A substantial amount of current drilling activity involves drilling deviated and horizontal wellbores to more fully exploit hydrocarbon reservoirs. Often referred to as directional drilling, this drilling technique can provide boreholes that have relatively complex well profiles. One known deflection tool for directional drilling has a housing with an inner surface and an outer surface, the inner surface having an inner surface longitudinal axis and the outer surface having an outer surface longitudinal axis that is offset and/or at an angle from the inner surface longitudinal axis. As a result, the outer diameter of the tilted drive sub is remaining straight with comparison to the mud motor's outer diameter while the internal bearing components are radially offset and/or offset at some predetermined angle. This concept allows to bring the position of the tilt relatively close to the drill bit. The effective bit to bend distance, known as one of the parameters for the design of a directional drilling motor, can be minimized using this approach. The bit to bend distance is defined by the distance from the inclined bearing axis intersection point with the longitudinal tool axis to the bit face for this concept. One drawback of the prior art tilted drive sub design is the inability to change the offset angle without parts exchange and also complete disassembly/ assembly of the bearing unit. Other known tools for directional drilling are bent subs or adjustable kickoff (AKO) tools. These tools utilize a deflection device that creates a tilt in the outer housing of a BHA. The tilt angle of the AKO can be adjusted on a rig floor.

Because adjustable kickoff tools are positioned uphole of a bearing section, these assemblies are known to exert high side loads and bending moments at the drill bit, the stabilizer, and the bend, caused by the large bit to bend distance, thus creating high bit offset. This is especially the case when they are used for drilling a straight section of the wellbore. In such instances, the housing, which includes the bend, is rotated. High side load in combination with misalignment of the bearing/drive shaft axes and the housing axis contributes to wear and damage of the radial and/or axial bearing. Bearing wear is known to be one major contributor to service limitation and repair costs.

Another known tool for directional drilling is a rotary steering system configured for directional drilling with continuous rotation from the earth's surface. Rotary steering systems may utilize a so-called non-rotating sleeve that is rotatably disposed around the drill string by means of a bearing system. Actuator elements are used to push the non-rotating sleeve outwards to create a deflection on the drill string. The deflections on the drill string create high side loads and bending moments on the drill string and/or the non-rotating sleeve which may create a higher probability for damage or wear in the bearing system supporting the non-rotating sleeve. A similar embodiment comprises a non-rotating stabilizer that is rotatably disposed around the drill string utilizing a bearing system.

The present disclosure addresses these and other drawbacks of the prior art directional drilling tools and generally addresses the need for more robust and durable devices for drilling wellbores.

SUMMARY OF THE DISCLOSURE

In aspects, the present disclosure provides an apparatus for use in a wellbore in a subterranean formation. The apparatus may include a drill string section; a drive shaft disposed in the drill string section, a bearing assembly connected to the drive shaft, the bearing assembly including at least one axial bearing and at least one radial bearing; and an alignment assembly connecting the bearing assembly to the drill string section. The bearing assembly may include at least one axial bearing and at least one radial bearing. The alignment assembly may have a first alignment member and a second alignment member slidingly engaging one another to allow at least a portion of the drive shaft to tilt relative to the drill string section.

In aspects, the present disclosure provides a method for performing an operation in a wellbore in a subterranean formation. The method includes the steps of positioning a drive shaft in a drill string section; connecting a bearing assembly to the drive shaft using an alignment assembly, the bearing assembly including at least one axial bearing and at least one radial bearing, the alignment assembly having a first alignment member and a second alignment member; and allowing at least a portion of the drive shaft to tilt relative to the drill string section using the alignment assembly by having the first alignment member and the second alignment member slidingly engage one another.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a steerable system for drilling wellbores. In general, the described steering methodology involves deflecting the angle of the drill bit axis relative to the longitudinal tool axis.

Figure 1:
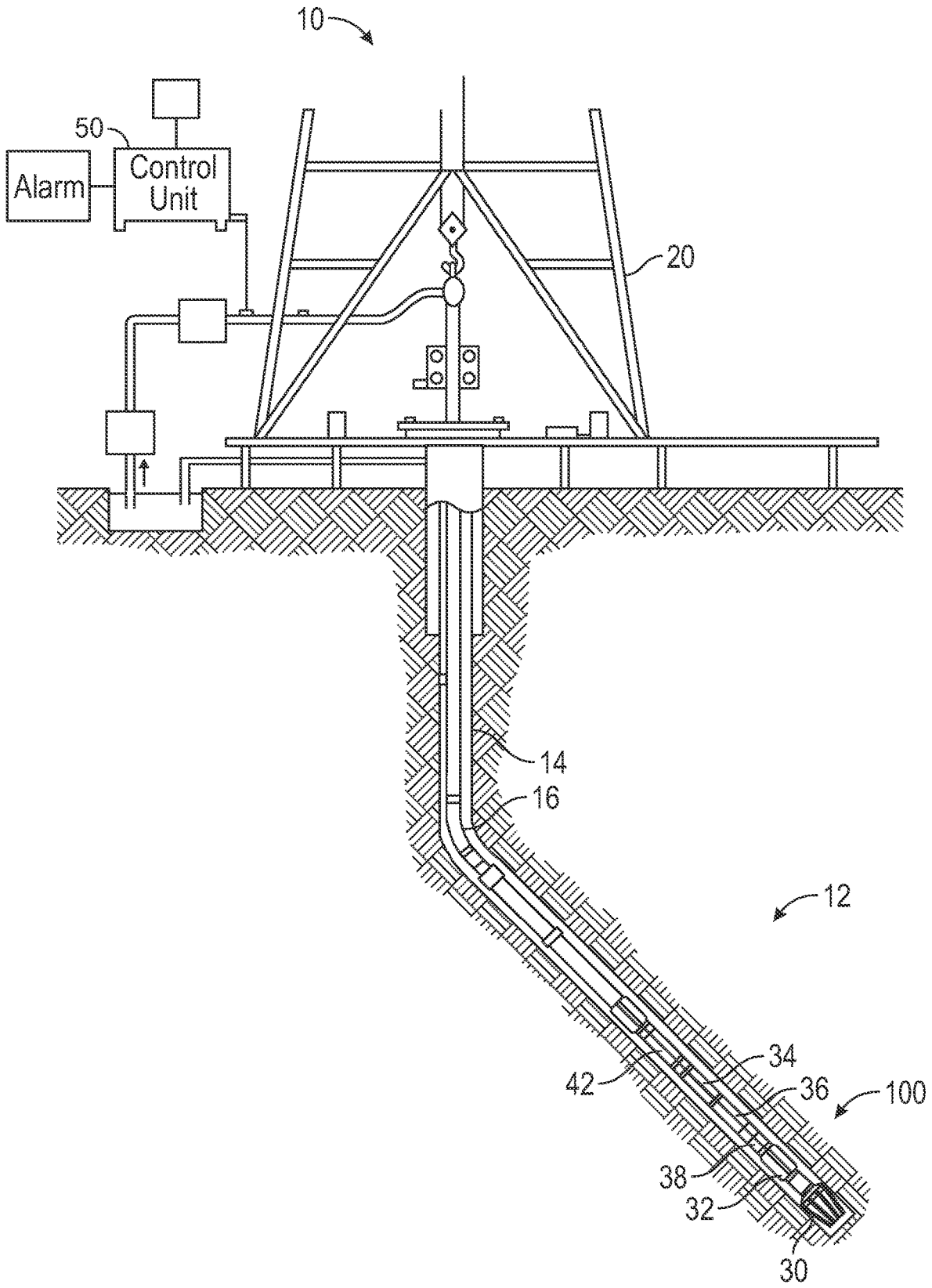
FIG. 1 illustrates a drilling system made in accordance with one embodiment of the present disclosure.

Referring now to FIG. 1, there is shown one illustrative embodiment of a drilling system 10 utilizing a steerable drilling assembly or bottomhole assembly (BHA) 12 for directionally drilling a wellbore 14. While a land-based rig is shown, these concepts and the methods are equally applicable to offshore drilling systems. The system 10 may include a drill string 16 suspended from a rig 20. The drill string 16, which may be jointed tubulars or coiled tubing (not shown), may include power and/or data conductors (not shown) such as wires for providing bidirectional communication and power transmission. In one configuration, the BHA 12 includes a drill bit 30, a sensor sub 32, a communication and/or power module 34, a formation evaluation sub 36, and one or more rotary power devices 38 such as drilling motors (e.g. electrical motors or mud motors). The sensor sub 32 may include sensors and tools for measuring a direction of at least a part of the drill string 16 and/or BHA (e.g., BHA azimuth, inclination, toolface, and/or BHA coordinates, etc.). The sensors and tools may be positioned relatively close to the drill bit 30 for measuring near-bit direction or near-bit position. The sensors and tools may be configure for making measurements while the drill string 16 is rotationally stationary or while the drill string 16 is rotating to generate stationary or rotary directional surveys, respectively. The sensor sub 32 may include two (2) or three (3) axis accelerometers, magnetometers, gyroscopic devices and signal processing circuitry. The system may also include information processing devices such as a surface controller 50 and/or one or more downhole controller 42. The drill bit 30 may be rotated by rotating the drill string 16 and/or by using a drilling motor, or other suitable rotary power device 38. By drilling motor, it is meant mud motors, turbines, electrically powered motors, etc. Communication between the surface controller 50 and the BHA 12 may use uplinks and/or downlinks generated by a mud-driven alternator, a mud pulser, a mud siren, or a mud valve as known in the art, and/or may be conveyed using the drilling fluid column. Alternatively or in addition, uplinks and/or downlinks may be conveyed using acoustic conductors, electric conductors (e.g., hard wires), and/or optical conductors (e.g., optical fibers). The signals used for communication may be drilling fluid pressure variations, acoustic signals, electric/electromagnetic signals including radio-frequency signals, and/or optical signals. The BHA 12 may also include a steering system configured to adjust or control a direction of at least a part of the BHA 12 to drill wellbore 14 into a desired direction. Examples of steering assemblies are tilted motors, kickoff motors, adjustable kickoff motors, tilted drive shafts (also known as tilted drive subs), or rotary steerable systems. As will be discussed in greater detail below, the BHA 12 may include a self-aligning bearing assembly that reduces wear of bearings during directional drilling and other situations.

Figure 2A:
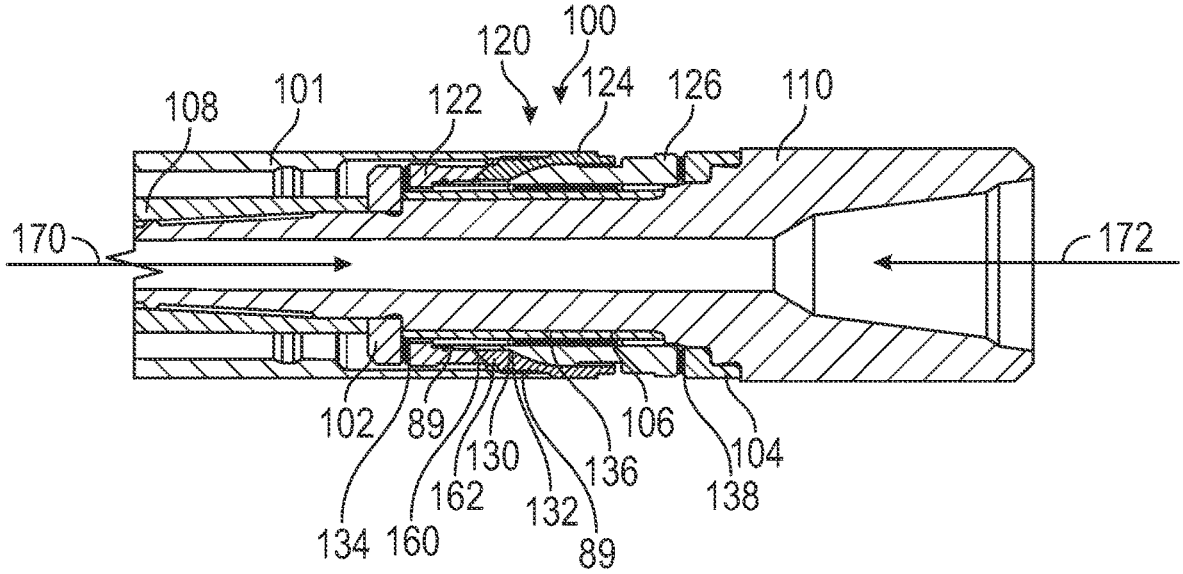
FIG. 2A schematically illustrates a drill string section with a self-aligning bearing assembly made in accordance with one embodiment of the present disclosure.

Referring to FIG. 2A, there is sectionally illustrated a self-aligning bearing assembly 100 for directionally drilling a borehole in a subterranean formation. The term "self-aligning" in this context means that the bearing assembly is configured to adjust its direction in response to forces applied to the bearing assembly. Examples of bearing assembly 100 include a friction bearing, such as a plain bearing, jewel bearing, journal bearing, plate bearing, Michell bearing, and a rolling-element bearing such as a ball bearing or a roller bearing. In general, those skilled in the art will appreciate that in cases sliding surfaces as presented below may be replaced by ball bearings or roller bearings. While this disclosure generally refers to sliding surfaces, it is therefore clear for those skilled in the art that sliding surfaced in this context may include ball bearings or roller bearings. Alternatively or in addition, embodiments of the bearing assembly 100 may include tapered and/or spherical bearings. The bearing assembly 100 is positioned on a drive shaft 110 connecting a drill bit 30 (FIG. 1) to a rotary power device 38 (FIG. 1) to convey torque created by the rotary power device 38 to the drill bit 30 to rotate the drill bit 30 (FIG. 1) by the rotary power device 38 (FIG. 1). The bearing assembly 100 includes an upper dynamic thrust bearing 102, a lower dynamic thrust bearing 104, and a dynamic radial bearing 106. The bearing assembly 100 is connected to a shaft (not shown), such as a flexible shaft, an articulated shaft, and a Cardan shaft, via bonnet 108. Bonnet 108 may include means to divert a flow of drilling fluid from an inner bore of bonnet 108 to the annulus between bonnet 108 and tool housing 101. The upper dynamic thrust bearing 102, the lower dynamic thrust bearing 104, and the dynamic radial bearing 106 are rotationally fixed to drive shaft 110, so that the upper dynamic thrust bearing 102, the lower dynamic thrust bearing 104, and the dynamic radial bearing 106 rotate with the same rotational velocity as the drive shaft 110 about the length axis of the drive shaft 110. In the embodiments of this disclosure, axial bearing and thrust bearing have the same broad meaning. Axial or thrust bearings prevent movement along a rotation axis while at the same time allow rotation about that rotation axis. Similarly, in the embodiments of this disclosure, the terms radial bearing and journal bearing have the same broad meaning. Radial or journal bearings prevent movement perpendicular to an rotation axis while at the same time allow rotation about the rotation axis. Consequently, the terms "axial" bearing and "thrust" bearing will be used interchangeably in that broad meaning and the terms "radial" and "journal" bearings will be used interchangeably in that broad meaning. For example, the terms "axial" or "thrust" bearings as used herein may comprise bearings with sliding surfaces that are not perpendicular to the rotation axis but may be tapered or tilted with respect to the rotation axis and may comprise sliding surfaces that are plane or curved such as spherical or elliptical surfaces. Further, the terms "radial" or "journal" bearings as used herein may comprise bearings with sliding surfaces that are not cylindrical with respect to the rotation axis and may comprise sliding surfaces that are tapered, tilted, or curved with respect to the rotation axis. Moreover, the terms "axial", "thrust", "radial", or "journal" bearings may also be understood to comprise more than one bearing or more than one pair of sliding surfaces. The terms "lower", "downward", "downhole", etc. and "upper", "upward", "uphole", etc. respectively describe axial directions along the wellbore 14 (FIG. 1) towards or away from drill bit 30 (FIG. 1).

The bearing assembly 100 includes a self-alignment assembly 120 that reduces the detrimental effects on the bearings 102, 104, 106 from deflection of a drive shaft 110 relative to a tool housing 101. In one non-limiting embodiment, the self-alignment assembly 120 includes a plurality of interconnected members that allow an amount of articulation; i.e., ability to pivot or tilt relative to one another. This articulation allows the self-alignment assembly 120 to passively accommodate the forces of the drilling process. The members can include an upper static thrust bearing 122, a carrier ring 124, and a lower static thrust bearing 126. Upper dynamic thrust bearing 102 and upper static thrust bearing 122 as well as lower dynamic thrust bearing 104 and lower static thrust bearing 126 comprise opposing sliding surfaces at least portions of which are plane and perpendicular to the longitudinal axis of the drive shaft 110. In the embodiments of this disclosure, "perpendicular" has a broad meaning. A surface is perpendicular to an axis when the angle between axis and surface is between 45° and 135°. For example, a surface is perpendicular to an axis when the angle between axis and surface is between 75° and 105°. Similarly, radial bearing 106 and lower static thrust bearing 126 have opposing sliding surfaces at least portions of which are cylindrical about the longitudinal axis of the drive shaft 110 and, thus, in at least one cross section perpendicular to the longitudinal axis of the drive shaft 110 and comprising the radial bearing 106, perpendicular to a line that is perpendicular to the longitudinal axis of the drive shaft 110. This arrangement of plane and cylindrical sliding surfaces ensures that, for the relatively fast rotation, the sliding surfaces are plane at least in a direction perpendicular to the sliding movement. Sliding surfaces that are plane at least in a direction perpendicular to the sliding movement are beneficial as they are generally less prone to wear. The upper static thrust bearing 122, the lower static thrust bearing 126, and the carrier ring 124 are rotationally fixed to tool housing 101 as described in more detail below, so that the upper static thrust bearing 122, the lower static thrust bearing 126, and the carrier ring 124 rotate with the same rotational velocity as the tool housing 101 about the length axis of the housing 101. The carrier ring 124 includes an inner contoured surface 130 that contacts an outer contoured surface 132 of the lower static thrust bearing 126. Likewise, the upper static thrust bearing 122 may have an inner contoured surface 160 that contacts an outer contoured surface 162 of the carrier ring 124. Upper static thrust bearing 122 and lower static thrust bearing 126. may be fixedly connected at one or more connections 89, e.g. by threads, welds, adhesive attachments, anti-rotation elements, or similar. Likewise, tool housing 101 and carrier ring 124 may be fixedly connected at one or more connections 89, e.g. by threads, welds, adhesive attachments, anti-rotation elements, or similar. Alternatively, upper static thrust bearing 122 and lower static thrust bearing 126 may be one integral part, and/or tool housing 101 and carrier ring 124 may be one integral part. Further, at least one of upper static thrust bearing 122, lower static thrust bearing 126, and carrier ring 124 may comprise two or more parts (not shown) that are connected, e.g. connected by threads, welds, adhesive attachments, anti-rotation elements, or similar, in a way that prevents relative rotation and/or linear movement of the two or more parts. A bearing assembly 100 with one integral part comprising upper static thrust bearing 122 and lower static thrust bearing 126 and/or tool housing 101 and carrier ring 124 may be made, e.g. by additive manufacturing such as but not limited to 3D printing. Alternatively or in addition, bearing assembly 100 may comprise integral half shells (not shown) comprising two or more of the parts shown in FIG. 2A and suited to assemble at least parts of bearing assembly 100.

Figure 2B:
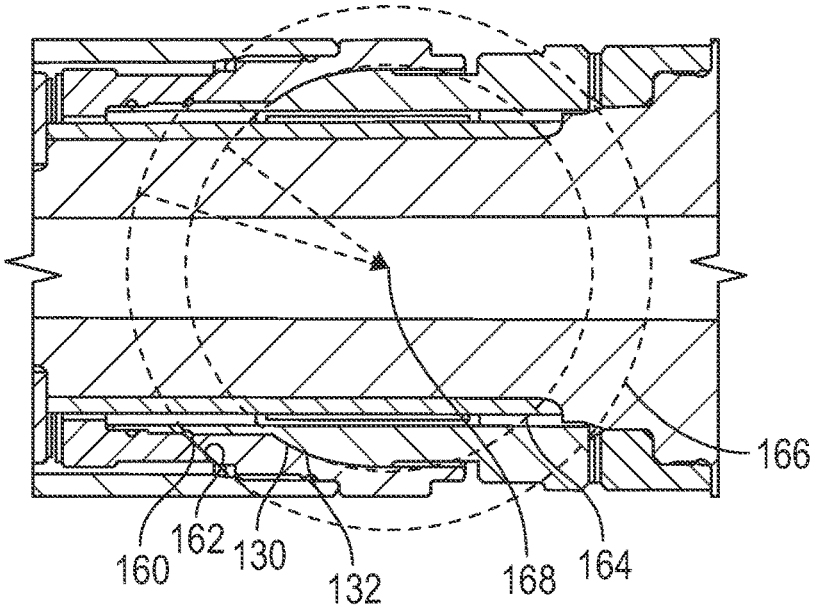
FIG. 2B schematically illustrates the contours of the sliding surfaces used in the FIG. 2A embodiment.

Referring to FIG. 2B, there are shown the contoured surfaces 130, 132, 160, and 162. In one arrangement, the contoured surfaces 130, 132 are aligned with a surface defined by a sphere 164 around a center point 168 and the contoured surfaces 160, 162 are aligned with a surface defined by a sphere 166 with the same center point 168. The spheres 164 and 166 have different diameters but share the common center point 168. The common center point 168 is located on the axis of drive shaft 110. While, in general, a center point of a sphere is mathematically infinitely small, the common center point 168 is not so limited. That is, the common center point 168 may actually comprise a region within which the center points of the spheres 164 and 166 are located and which is small enough to avoid damages to the alignment assembly 120 when upper static thrust bearing 122, carrier ring 124, and lower static thrust bearing 126 are moving with respect to each other. For example, the common center point 168 may comprise a region with an extension that is smaller than 30% of the radii of spheres 164 and 166. For example, the common center point 168 may comprise a region with an extension that is smaller than 10% of the radii of spheres 164 and 166. For example, the common center point 168 may comprise a region with an extension that is smaller than 3% of the radii of spheres 164 and 166. The surfaces 130, 132 and 160, 162 are arranged and positioned to allow the lower static thrust bearing 126 and the upper static thrust bearing 122 to rotate or pivot in a ball joint fashion about an axis perpendicular to the length axis of drive shaft 110 (FIG. 2). During this motion, there is relative sliding motion between the surfaces 130 and 132 and surfaces 160 and 162. Surfaces 160 and 162 account for axial and radial bearing loads directed opposite to those directed into surfaces 130, 132. Since spherical surface 130, 132 and 160, 162 share a common center point 168, a point of bearing tilt is defined at the common center point 168.

There are three areas through which torque is frictionally transferred from the drive shaft 110 into the bearing assembly 100. These include an upper thrust area 134 between the upper dynamic thrust bearing 102 and the upper static thrust bearing 122, an inner bearing area 136 between the radial bearing 106 and the lower static thrust bearing 126, and a lower thrust area 138 between lower dynamic thrust bearing 104 and the lower static thrust bearing 126. In the displayed assembly, the upper thrust area 134 transfers torque from the drive shaft 110 into the bearing assembly 120 by friction that is created of downward directed loads 170, caused by operations such as back-reaming, pulling or hydraulic thrust caused by the rotary power device 38 (FIG. 1). The lower thrust area 138 transfers torque from the drive shaft 110 into the bearing assembly 120 by friction that is created of upward directed loads 172 mainly caused by the drilling weight, sometimes also referred to as weight on bit (WOB).

Figure 3A:
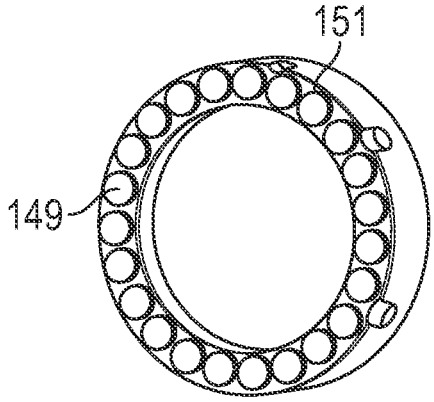
FIGS. 3A-B illustrate polycrystalline diamond compact (PDC) inserts that may be used with a self-aligning bearing assembly made in accordance with one embodiment of the present disclosure.
Figure 3B:
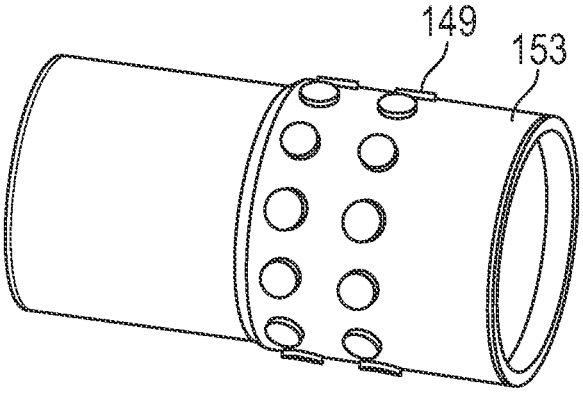

To enhance performance and service life, bearing surfaces, such as opposing surfaces of upper dynamic thrust bearing 102, upper static thrust bearing 122, radial bearing 106, lower static thrust bearing 126, and lower dynamic thrust bearing 104 may include surface treatments and features, including but not limited to flame spray coatings, high velocity oxygen fuel (HVOF) spray coatings, laser weld coatings, ceramic inserts, tungsten carbide inserts (T2A), and diamond bearing elements to reduce abrasive wear. FIGS. 3A-B illustrate diamond bearing elements 149, such as polycrystalline diamond compact (PDC) bearing elements that may also be distributed on the bearing surfaces described above and other surfaces to provide greater resistance to wear. As shown, the elements 149 may be disposed on an end face 151 as shown in FIG. 3A (e.g., an end face of upper dynamic thrust bearing 102 or radial bearing 106 in FIG. 2) and/or on an inner circumferential surface and/or outer circumferential surface 153 as shown in FIG. 3B (e.g. outer circumferential surface of radial bearing 106 or inner circumferential surface of lower static thrust bearing 126).

Figure 4:
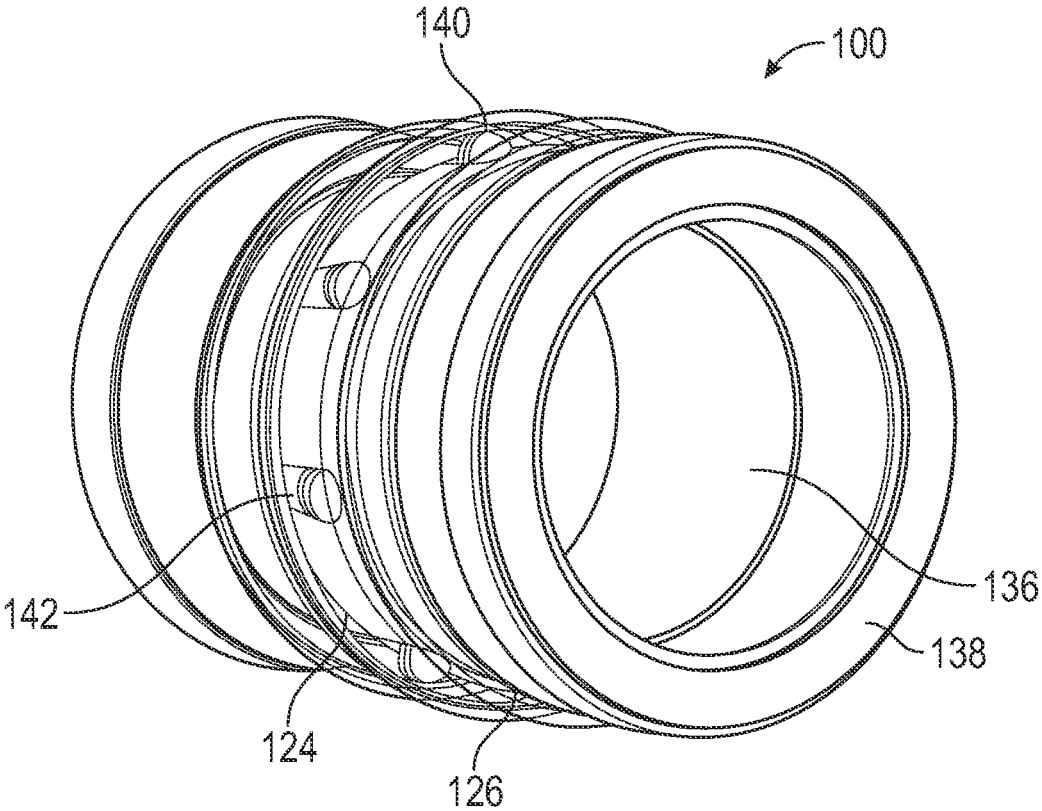
FIG. 4 illustrates anti-rotation elements in accordance with one embodiment of the present disclosure for locking portions of the self-aligning bearing assembly.

Referring to FIG. 4, in one arrangement, anti-rotation elements 140 are positioned between the carrier ring 124 and the lower static thrust bearing 126 to prevent relative rotational movement about the longitudinal drive shaft axis between lower static thrust bearing 126 and carrier ring 124 and ultimately between upper static thrust bearing 122, lower static thrust bearing 126, carrier ring 124, and tool housing 101. Anti-rotation elements 140 may prevent relative rotation about a first axis but may allow relative rotation about a second axis. For example, anti-rotation elements 140 may prevent relative rotation about the longitudinal drive shaft axis while allowing relative rotation about an axis that is perpendicular to the longitudinal drive shaft axis. For instance, the anti-rotation elements 140 may be disposed in elongated slots 142 formed in either or both of the inner and outer contoured surfaces 130, 132 (FIG. 2) and can be positioned at the surface of sphere 164 that is associated with outer contoured surface 132 and in a plane perpendicular to the longitudinal drive shaft axis that includes the common center point 168. The slots 142 are elongated parallel with the longitudinal axis of the drive shaft. The anti-rotation elements 140 have the freedom to move along the elongated slots 142, which allows the upper static thrust bearing 122 and the lower static thrust bearing 126 to incline or tilt with respect to carrier ring 124 about an axis that is perpendicular to the longitudinal drive shaft axis in a desired direction. This arrangement locks the three translational degrees of freedom and the rolling degree of freedom (about the longitudinal tool axis) of the bearing assembly 100, while keeping the pitching and yawing degree of the drive shaft 110 free in any direction about an axis that is perpendicular to the longitudinal drive shaft axis (omni-directional tilt) and the rotating degree of the drive shaft 110 about the longitudinal drive shaft axis free. Respectively opposing sliding surfaces of upper dynamic thrust bearing 102 and upper static thrust bearing 122, radial bearing 106 and lower static thrust bearing 126, as well as lower static thrust bearing 126 and lower dynamic thrust bearing 104 allow for the rotation about the longitudinal axis of the drive shaft while limiting the axial and lateral movement of the drive shaft 110. At the same time, opposing inner contoured surface 160 and outer contoured surface 162, as well as inner contoured surface 130 and outer contoured surface 132 allow for the omni-directional tilt of the drive shaft 110, the upper dynamic thrust bearing 102, the radial bearing 106, the lower dynamic thrust bearing 104 and their opposing sliding surfaces in upper static thrust bearing 122 and lower static thrust bearing 126 while limiting the axial and lateral movement of the drive shaft 110, the upper dynamic thrust bearing 102, the radial bearing 106, the lower dynamic thrust bearing 104 as well as the rotation of tool housing 101, carrier ring 124, upper static thrust bearing 122, and lower static thrust bearing 126 with respect to each other. Hence, this arrangement ensures that, for the relatively fast rotation about the longitudinal drive shaft axis, the sliding surfaces are plane at least in a direction of the sliding movement (plane or cylindrical surfaces) while for the relative slow pitching and yawing movement, opposing sliding surfaces are at least partially of spherical shape to ensure the omni-directional tilt. The arrangement also ensures that in the self-aligning bearing assembly 100, the opposing sliding surfaces supporting the rotational movement about the longitudinal axis of the drive shaft 110 tilt about an axis perpendicular to the longitudinal drive shaft axis with substantially the same angle. For example, in the arrangement as shown in FIGS. 2, 2A, 4, and 5, when the drive shaft 110 tilts with an angle $\alpha$ about an axis perpendicular to the longitudinal axis of the drive shaft 110, the self-aligning bearing assembly 100 ensures that the respectively opposing sliding surfaces of upper dynamic thrust bearing 102 and upper static thrust bearing 122, radial bearing 106 and lower static thrust bearing 126, as well as lower static thrust bearing 126 and lower dynamic thrust bearing 104 tilt with substantially the same angle $\alpha$. Notably, the self-aligning bearing assembly is a passive element that does not receive external power and/or communication to provide this function. In one non-limiting embodiment, the anti-rotation element 140 may be rigid bodies, such as pins, keys, balls, or cylinders, such as metal pins, keys, balls or cylinders that physically contact the carrier ring 124 and the lower static thrust bearing 126. In another non-limiting embodiment anti-rotation elements 140 can alternatively be flexible members that have flexibility to deform along the elongated slots 142, hence allowing the upper static thrust bearing 122 and the carrier ring 124 to incline or tilt even without sliding movement of the whole anti-rotation elements 240 with respect to the upper static thrust bearing 122 and the carrier ring 124. That is, only a portion of anti-rotation element 240 slide along the elongated slots 142 to allow the upper static thrust bearing 122 and the carrier ring 124 to incline or tilt. Flexible anti-rotation elements 140 could be spring elements (e.g. helical springs, leaf springs) or other connecting elements that offer sufficient flexibility to account for the relatively small movement along the elongated slots 142 with deformation of the anti-rotation elements 140 (connecting elements), even when the anti-rotation elements 140 are rigidly coupled to one or both of the upper static thrust bearing 122 and the carrier ring 124.

Figure 5:
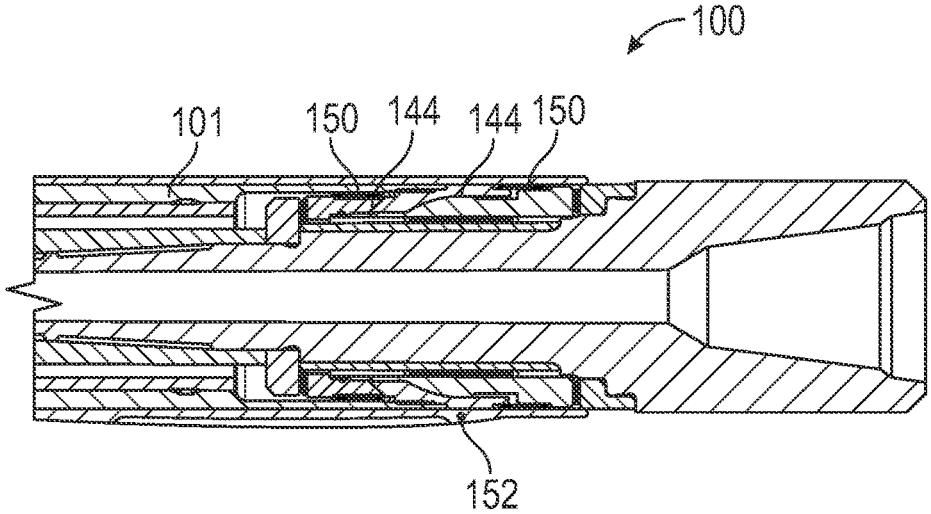
FIG. 5 illustrates protection members made in accordance with one embodiment of the present disclosure.

Referring to FIG. 5, there are illustrated protection features 150 that may be used to prevent particles in a fluid surrounding the tool housing 101 from entering and damaging the internal components of the bearing assembly 100. The protection features 150 may be a protective covering, such as a sleeve or bellows that seal the gaps 144 between the components of the bearing assembly 100. The protection features 150 prevent fluids with entrained abrasive material from entering into the gaps 144. As opposed to sleeves or bellows as illustrated in FIG. 5, the protection features 150 might also be of other types such as, but not limited to O-Ring seals, hydraulic seals, metal bellows, barrier fluids, labyrinth seals between upper static thrust bearing 122 (FIG. 2) and carrier ring 124 (FIG. 2), as well as between carrier ring 124 (FIG. 2) and lower static thrust bearing 126 (FIG. 2), respectively. As would be apparent to those skilled in the art, protection features 150 may be omitted in favor of erosion/abrasion wear resistant materials or coatings at the sliding surfaces for upper static thrust bearing 122, carrier ring 124 and lower static thrust bearing 126 or any other part of bearing assembly 100 as displayed in FIG. 2. protection features 150 may not prevent fluid from flowing between sliding surfaces, such as sliding surfaces of thrust bearing 102, upper static thrust bearing 122, radial bearing 106, lower static thrust bearing 126, and lower dynamic thrust bearing 104 for lubrication and cooling purposes. Additionally, a mechanical protection feature 152 such as a sleeve may be used to cover and mechanically protect the entire bearing assembly 100 from damaging contact with external features such as borehole wall or cuttings (not shown). The mechanical protection feature 152 may be formed of rubber, plastic, a metal, or any other suitable material. The protective cover may also carry a stabilizer centralizing the assembly inside the borehole wall. In such cases, the centralizing element additionally carries a protective layer made of a suitable wear resistant material, such as but not limited to tungsten carbide.

Figure 6A:
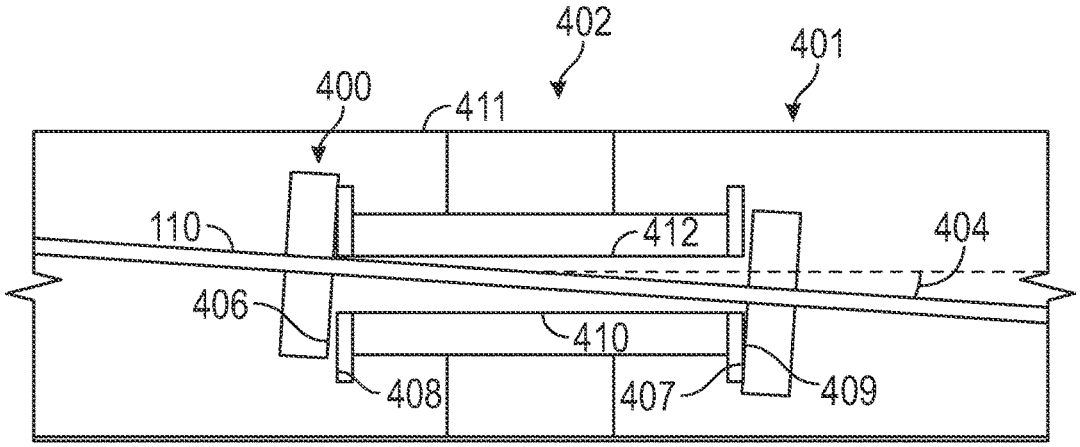
FIGS. 6A-B illustrate bearing assembly behavior for conventional bearing arrangements and bearing arrangements according to the present disclosure, respectively.

FIGS. 6A and B schematically illustrative the behavior of a conventional bearing assembly and a bearing assembly according to the present teachings, respectively. The bearings illustrated therein have been simplified for clarity. FIG. 6A illustrates thrust bearings 400, 401 that are rigidly coupled to a drive shaft 110 and a radial bearing 402 that is rigidly coupled to a housing 411 when encountering a drive shaft deflection 404 with respect to the housing. As can be seen, the shaft deflection 404 causes non-parallel contact between the sliding surfaces 406, 408 and 407, 409 of the thrust bearings 400, 401, respectively, as well as between sliding surfaces 410, 412 of the radial bearing 402 and the drive shaft 110. This non-parallel contact could lead to line contact; i.e., a load on a relatively small area as opposed to a distributed load. Line contacts can cause extreme contact pressures in the drilling application, ultimately leading to premature defects or failure.

Figure 6B:
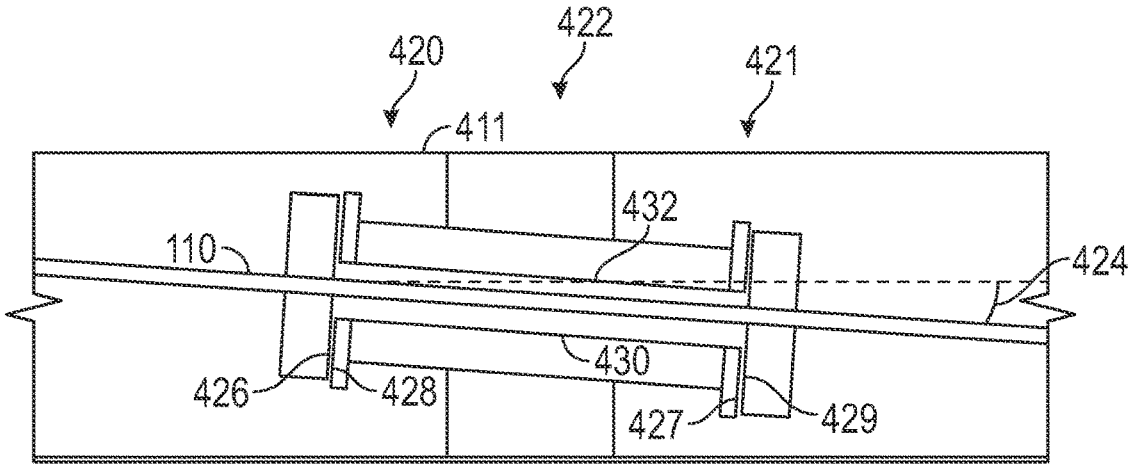

FIG. 6B schematically illustrates how thrust bearings 420, 421 and a radial bearing 422 provided with alignment features according to the present teachings follow the deflection 424 of a drive shaft 110 without creating any non-parallel contact of sliding surfaces, line contacts or significant righting moment. As can be seen, the shaft deflection 424 does not cause uneven contact between the sliding surfaces 426, 428 and 427, 429 of the thrust bearings 420, 421 or between the sliding surfaces 430, 432 of the radial bearing 422 and the drive shaft 110. Rather, the sliding surfaces 426, 428, 427, 429, 430, 432 remain generally parallel and are not subjected to line contact. Thus, bearing assemblies according to the present disclosure significantly reduce bearing damages in applications for directional drilling involving a directional drilling motor, e.g. a directional drilling motor that is equipped with a fixed or adjustable bend housing uphole of the bearing section.

Thus, it should be appreciated that the teachings of the present application can protect radial and axial (journal) bearings from damage due to intentional and unintentional misalignment of bearings in response to misalignment of a drive shaft. Shaft deflection, typically caused by side loads as described above, can affect the surfaces of a thrust bearing in a similar fashion as the surfaces of radial bearing. Thus, embodiments of the present disclosure comprise the combination of the radial and thrust or axial bearing into one assembly that is protected by a common self-alignment bearing assembly 100. Combining the radial and thrust bearings into one assembly beneficially allows the pitching and yawing degree of freedom (omni-directional tilt) of the non-rotating bearing elements, aligning with the rotating bearing in the event of drive shaft deflection in a relatively short assembly.

The above-described embodiments of the self-alignment bearing assembly 100 is only one non-limiting arrangement of the present disclosure. For instance, the FIG. 2A embodiment positions the alignment features, e.g., the outer and inner contoured surfaces 130, 132 and 160, 162, on the housing, which is at a different rotational velocity or stationary relative to the drive shaft 110. In other embodiments, these features may be on the drive shaft 110 and thereby rotate with the drive shaft 110 about the longitudinal axis of the drive shaft 110. It should be noted that since the deflection is primarily aligned with the housing and in direction of the housing bend, the use of the self-alignment features at the housing would be relatively stationary. If the alignment features are connected to the drive shaft 110, then the deflection changes every shaft revolution.

Figure 7:
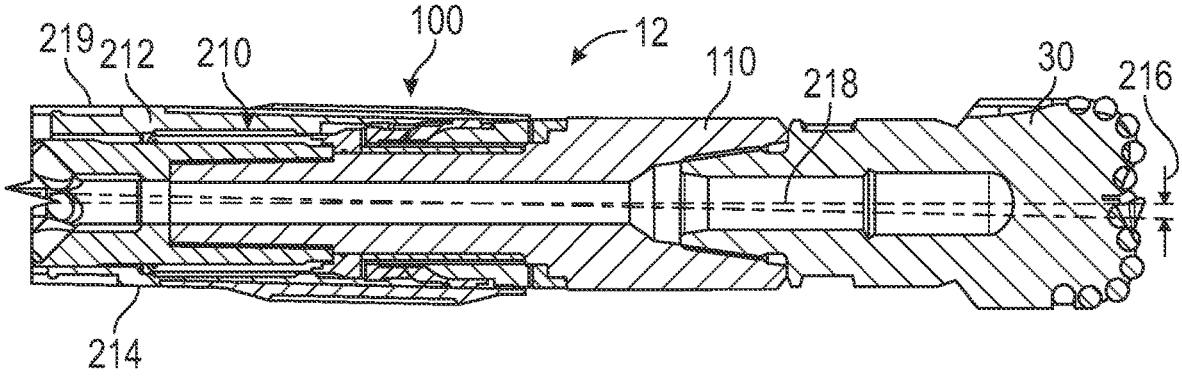
FIGS. 7 and 8 illustrate a fixed eccentricity member for providing a predetermined tilt for a drive shaft in accordance with one embodiment of the present disclosure.

Bearing assemblies according to the present disclosure may be used in a variety of configurations for downhole tools. One non-limiting configuration involves a downhole tool for directional drilling. In particular, the disclosed bearing assemblies may be used with steerable drilling systems that utilize a tilted drive shaft (also known as tilted drive sub, FIGS. 7-9D). In FIG. 7, there is shown a section of a bottomhole assembly 12 that includes the drill bit 30, a drive shaft 110, and the bearing assembly 100. Tilting the drive shaft effects a change in drilling direction by influencing the way the drill bit 30 and bottom hole assembly 12 lays in the previously drilled hole so as to influence the tilt 216 of the drill bit 30. The end effect is that the drill bit face points or tilts in a selected orientation for the selected new direction of the hole.

Figure 8:
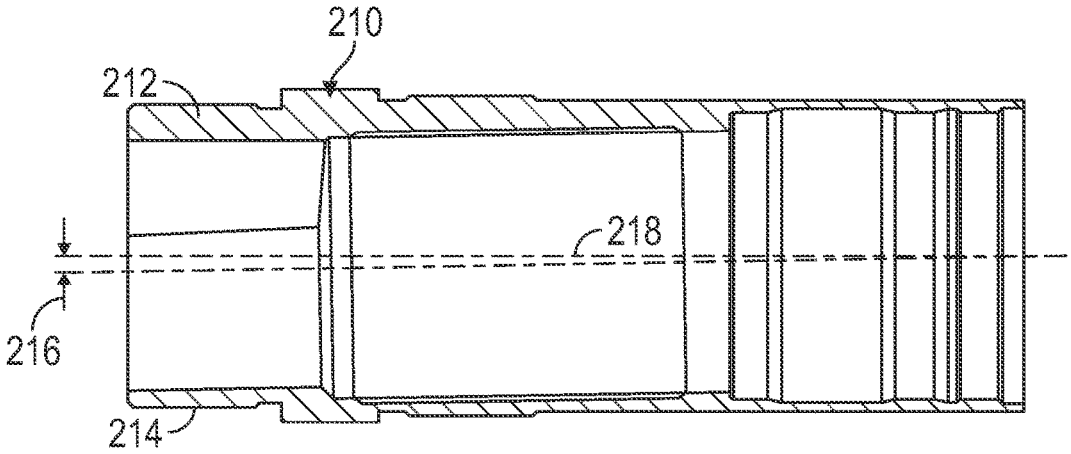
Figure 9A:
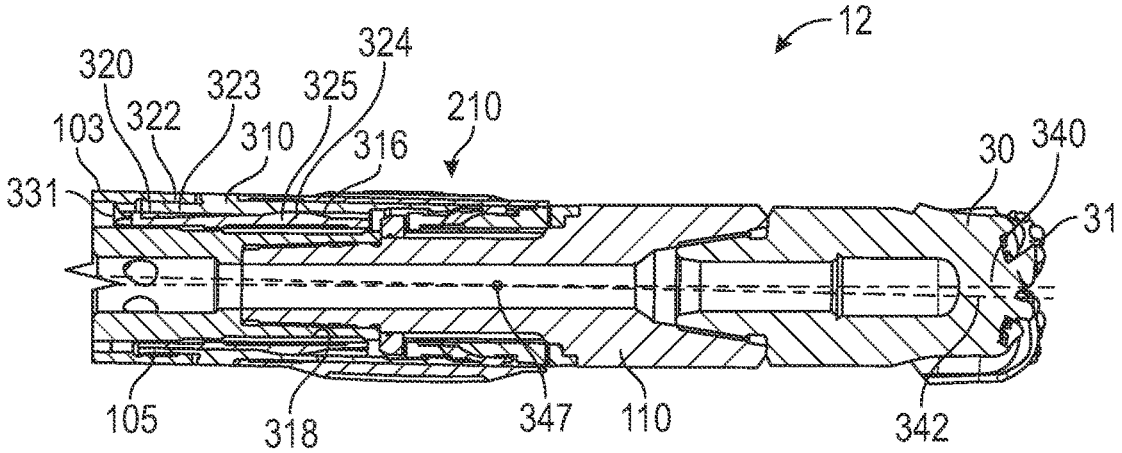
FIGS. 9A-D illustrate an adjustable eccentricity member for providing an adjustable amount of tilt for a drive shaft in accordance with one embodiment of the present disclosure.

Referring to FIGS. 7, 8, and 9A, in embodiments, one or more components of the bearing assembly 100 may include one or more eccentricity members having an eccentricity and/or a geometry that is tilted or asymmetric with respect to the longitudinal tool axis and that causes a deflection of the drive shaft 110 and the drill bit 30 with respect to a longitudinal tool axis 218 of the drill string section 219. The deflection may cause a tilt that is relatively fixed, e.g. a tilt that cannot be adjusted. Referring to FIGS. 7 and 8, for instance, the upper bearing 210 may be an eccentricity member constructed to have a wall thickness asymmetric with respect to a longitudinal tool axis 218 that results in one portion 212 of the wall being thicker than another portion 214 of the wall. The variation in thickness causes the drive shaft to have a tilt 216 relative to the longitudinal tool axis 218. In order to adjust the tilt to a different angle, the assembly as displayed in FIG. 7 needs to be disassembled to exchange the upper bearing component 210 with one that has a different eccentricity and thus causes a different tilt. A higher tilt would be beneficial to drill narrower curvatures, while a smaller tilt would be beneficial to drill straighter sections and do corrections only. Advantageously, the self-aligning bearing assembly 100 (FIG. 2) orients the thrust and radial bearings described previously. Also, identical components can be used for bearing assembly 100 regardless of eccentricity of upper bearing 210 to reduce potential damage to bearing surfaces from misalignment.

In embodiments, the upper bearing 210 may be configured to have an adjustable tilt; e.g., a tilt axis adjustable between no tilt and a tilt of about 1°, or a higher value such as 5°. FIGS. 9A-D illustrate an upper bearing 210 that uses two or more eccentricity members to vary the tilt angle. The two components may move relative to one another such that the eccentricities either offset one another to minimize a tilt angle or complement one another to maximize tilt angle. Of course, the eccentricities may also be set to provide an intermediate tilt angle value.

Figure 9B:
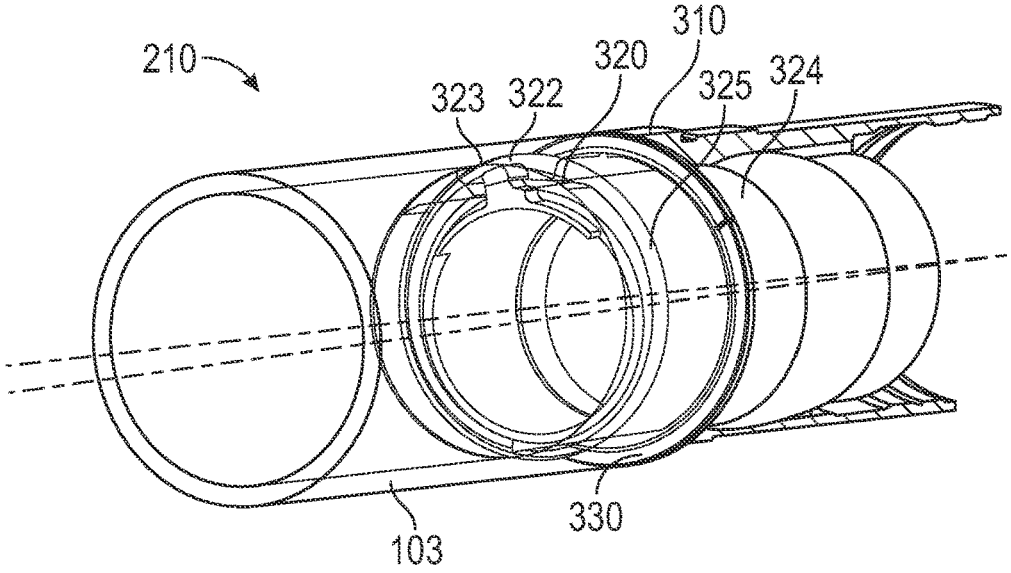

Referring to FIGS. 9A-B, in one non-limiting embodiment, a first eccentricity member, also known as upper bearing 210 generates a first eccentricity using a bearing housing 310 having an eccentric inner surface, creating the first eccentricity member. The bearing housing 310 includes an inner contour 320 that is eccentric and/or at an angle with respect to the longitudinal tool axis 342. For example, as shown in FIG. 9A the bearing housing 310 includes an inner contour 320 that is eccentric and/or at an angle with respect to an outer contour 322 of the housing wall such that a first enlarged portion 323 is formed, hence bearing housing 310 has one side with an enlarged wall thickness and one opposite side with a narrower wall thickness. The eccentric and/or asymmetric inner contour 320 of bearing housing 310 is complementary to a second eccentricity member, such as female radial bearing 324. Referring to FIGS. 9A and C, another eccentric and/or asymmetric eccentricity member is formed using a female radial bearing 324 with an outer contour 316 that is eccentric to the inner radial bearing surface 318. Thus, the female radial bearing 324 has a first side with an enlarged wall portion 325 and an opposing side with a narrower wall thickness. The female radial bearing 324 can be rotated inside the contour 320 of bearing housing 310 about its center line 340 by means of a keyed connection 331 between an upper housing 103 and the female radial bearing 324.

Figure 9C:
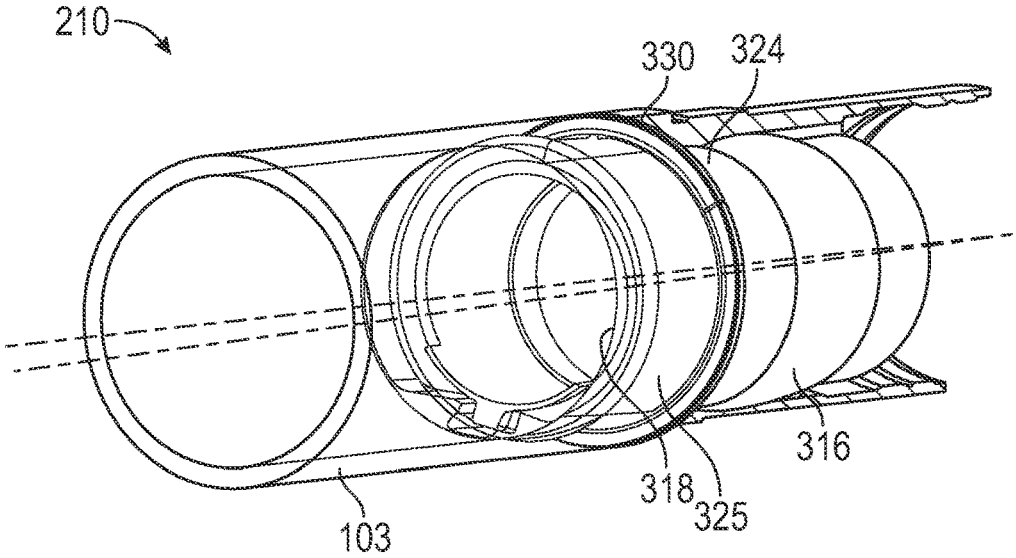
Figure 9D:
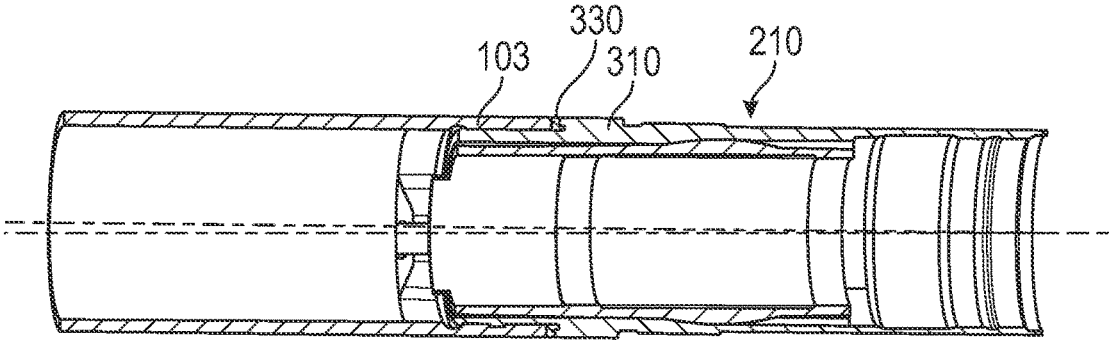

In one non-limiting configuration, the upper housing 103 and the female bearing housing 310 are connected through a threaded portion 105. To adjust the tilt, the upper housing 103 is rotated about its center line 342 with respect to the bearing housing 310. Differences in thicknesses of the bearing housing 310 and the female radial bearing 324 adjusts the relative rotary angle between the upper housing 103 and the bearing housing 310. This is also reflected by the tilt between the center line 340 of the bearing (also known as bearing axis) and the center line 342 of the upper housing 103 (also known as longitudinal tool axis 218 (FIG. 7) of the drill string section 219 (FIG. 7)). Referring to FIG. 9B, in one embodiment, the maximum tilt created by aligning both enlarged portions 323, 325 towards the same side is 1° and the thread pitch of threaded portion 105 is 4 mm per revolution. Referring to FIG. 9D, a half shell ring 330 may be installed between upper housing 103 and female bearing housing 310. Use of half-shell rings 330 with various widths may result in various distances between upper housing 103 and bearing housing 310 when screwed together. It is apparent, that with the pitch of the thread, the various distances between upper housing 103 and bearing housing 310, upper housing 103 and bearing housing 310 will have various azimuthal offsets with respect to each other when screwed together. For example, with a width of half-shell ring 330 that is reduced by 1 mm, upper housing 103 and bearing housing 310 are rotated about 90° with respect to each other, thus reducing the tilt to about 0.5°. A respective rotation of 180°, achieved by a reduction in thicknesses of the shell rings of 2 mm, would yield to a 0° tilt (straight assembly) as shown in FIG. 9C. FIG. 9A also shows the distance "bit to bend" from the point of intersection 347, where the two center lines 340 and 342 intersect, at common center point 168 defined by the spherical surface of the self-alignment bearing assembly 100 to the bit face 31 of the drill bit 30

Thus, it should be appreciated that manipulation of the angle and/or the thickness of the half shell rings 330 and thus of the tilt angle can create and/or define a tilt in the bearing assembly 100. The spherical surfaces 160,162 and 130, 132 allow for such adjustment without creating line contact in the actual sliding surfaces of upper dynamic thrust bearing 102, upper static thrust bearing 122, radial bearing 106, lower static thrust bearing 126, and lower dynamic thrust bearing 104 as explained earlier.

Figure 10A:
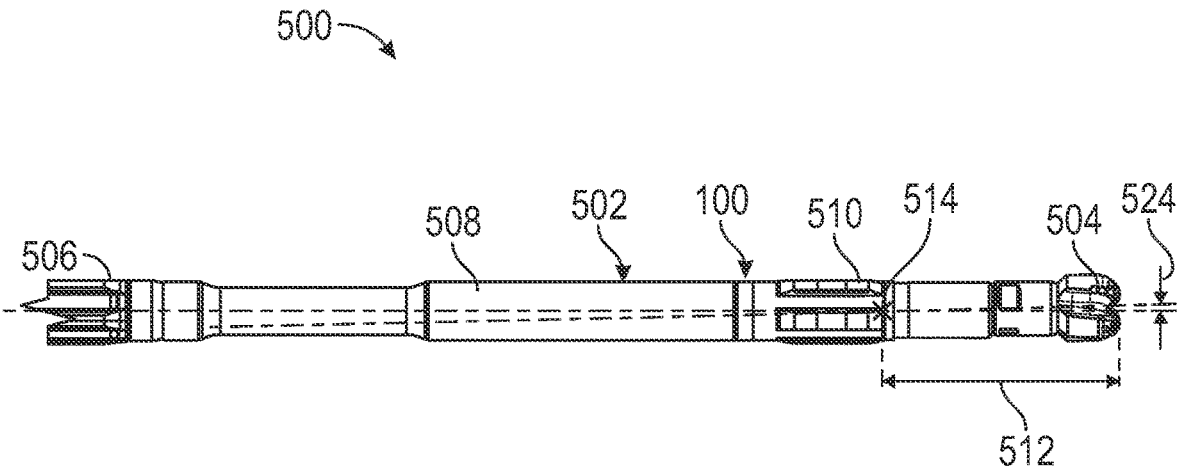
FIG. 10A illustrates geometric properties in accordance with one embodiment of the present disclosure.
Figure 10B:
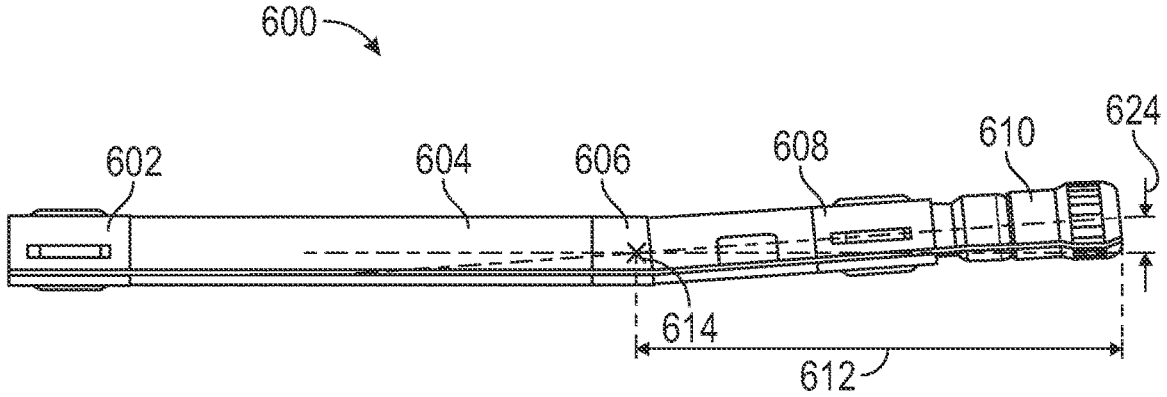
FIG. 10B illustrates geometric properties of a prior art system.
Figure 10D:
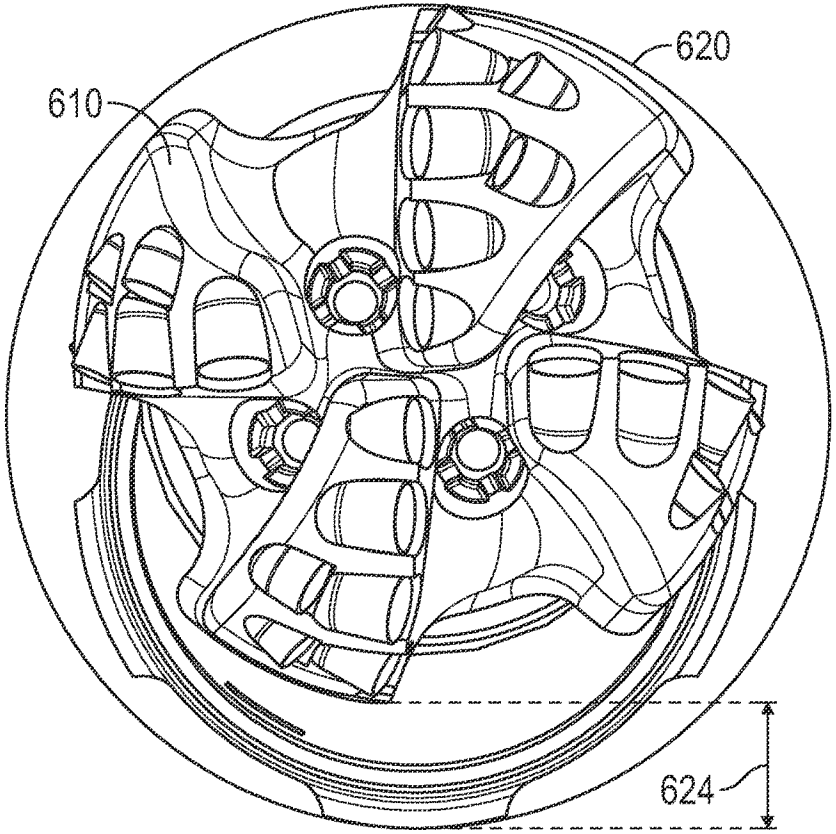
FIG. 10D illustrates drilling properties of a prior art system
Figure 10C:
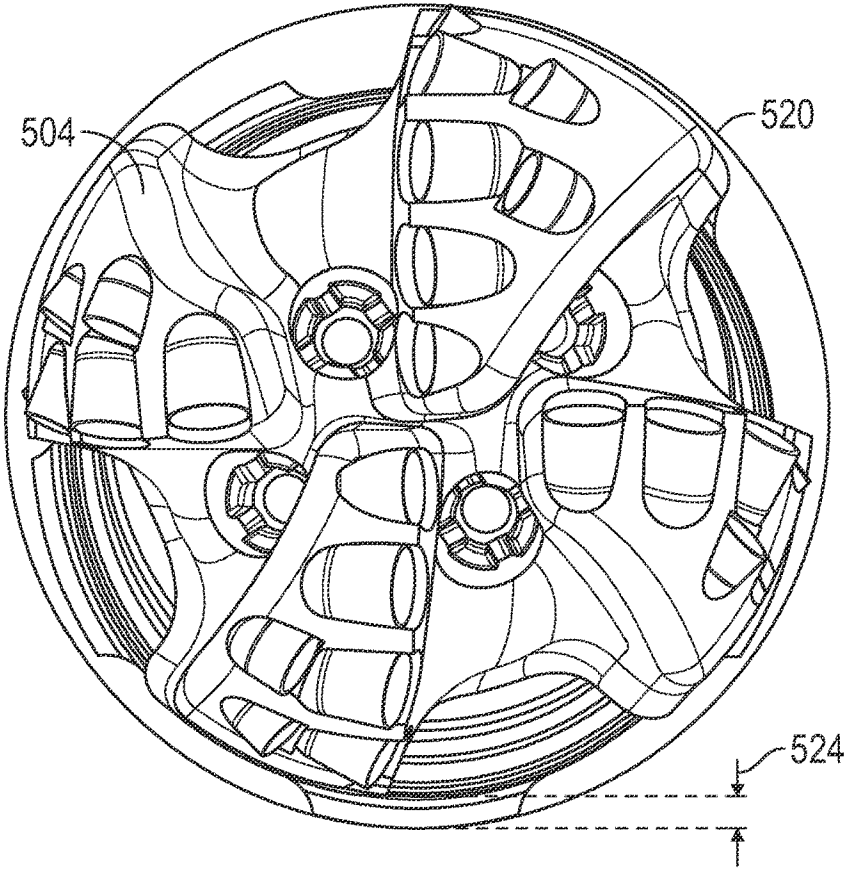
FIG. 10C illustrates drilling properties in accordance with one embodiment of the present disclosure.

FIGS. 10A and 10C illustrate the advantages of one non-limiting embodiment of a drilling system 10 according to the present disclosure over a prior art system, such as an AKO, as depicted in FIGS. 10B and 10D. FIG. 10A illustrates a drilling assembly 500 having a drill bit 504, a self-aligning bearing assembly 100, one or more stabilizers 506, 510, and a drilling motor 508. This self-aligning bearing assembly 100 in accordance with the embodiment discussed above allows the position of the tilt to be brought very close to the drill bit. The same amount of tilt would lead to extremely high forces in the bearings when used without the self-assigning bearing assembly 100 to create the same bit to bend distance, which ultimately would lead to high wear in the bearings. The effective bit to bend distance 502, known as one of the critical parameters for the design of a directional drilling motor can therefore be minimized using this approach. The bit to bend distance 502 is defined by the distance from the inclined bearing axis intersection point with the longitudinal tool axis to the bit face. Referring now to FIG. 10B it can be seen that in prior art systems without a self-aligning bearing assembly as described above, the bend above a bearing assembly always creates a larger bit to bend distance to keep the wear in the bearings within an acceptable range than an assembly according to the present disclosure which allows the bend to be positioned at the position of the lower bearing.

FIG. 10A shows a drilling assembly 500 according to the present disclosure that includes a self-aligning bearing assembly 100 as discussed previously disposed in a BHA 502 having a drill bit 504. The BHA 502 may further include a upper stabilizer 506, a drilling motor 508, and a lower stabilizer 510. The drilling assembly 500 has a bit to bend distance 512 as measured from the bend point 514, which may be the center point 168 inside the bearing assembly 100 as discussed with respect to FIG. 2B, to the drill bit 504. FIG. 10B illustrates a conventional system that has an upper stabilizer 602, a drilling motor 604, an AKO sub 606, a lower stabilizer 608, and a drill bit 610. The drilling assembly 600 has a bit to bend distance 612 as measured from the bend point 614 at the AKO sub 606 to the drill bit 610. As is apparent, the FIG. 10A drilling assembly 500 beneficially has a bit to bend distance 512 shorter than that of the conventional system 600 as displayed in FIG. 10B.

FIG. 10C and FIG. 10D illustrate the potential difference resulting from small versus larger bit to bend distance. During rotary drilling, the entire drill string rotates. Thus, the bit to bend distance can influence the degree to which an over gauge hole will be formed. Due to the relatively small bit to bend distance, the FIG. 10A drilling assembly 500 would create a relatively small over gauge hole as shown in FIG. 10C. In FIG. 10C, the drill bit 504 is circumscribed by a circle 520, which depicts the over gauge hole caused by the bit offset 524 at the drill bit 504. The FIG. 10B conventional drilling assembly 600, which has a larger bit to bend distance 612, would create a much larger bit offset 624 as shown in FIG. 10D. In FIG. 10D, the drill bit 610 is circumscribed by a circle 620, which depicts the over gauge hole caused by the bit offset 624 at the drill bit 610. This relatively large bit offset 624 causes a larger over gauge hole size during rotary drilling and also create higher side loads, affecting bearing and stabilizer wear and durability. Additional negative effects are well known to those skilled in the art and include borehole quality issues, lower ROP caused by the higher volume of rock being cut, issues in cuttings transport, issues in completions while setting casing and cementing, and others.

Figure 11:
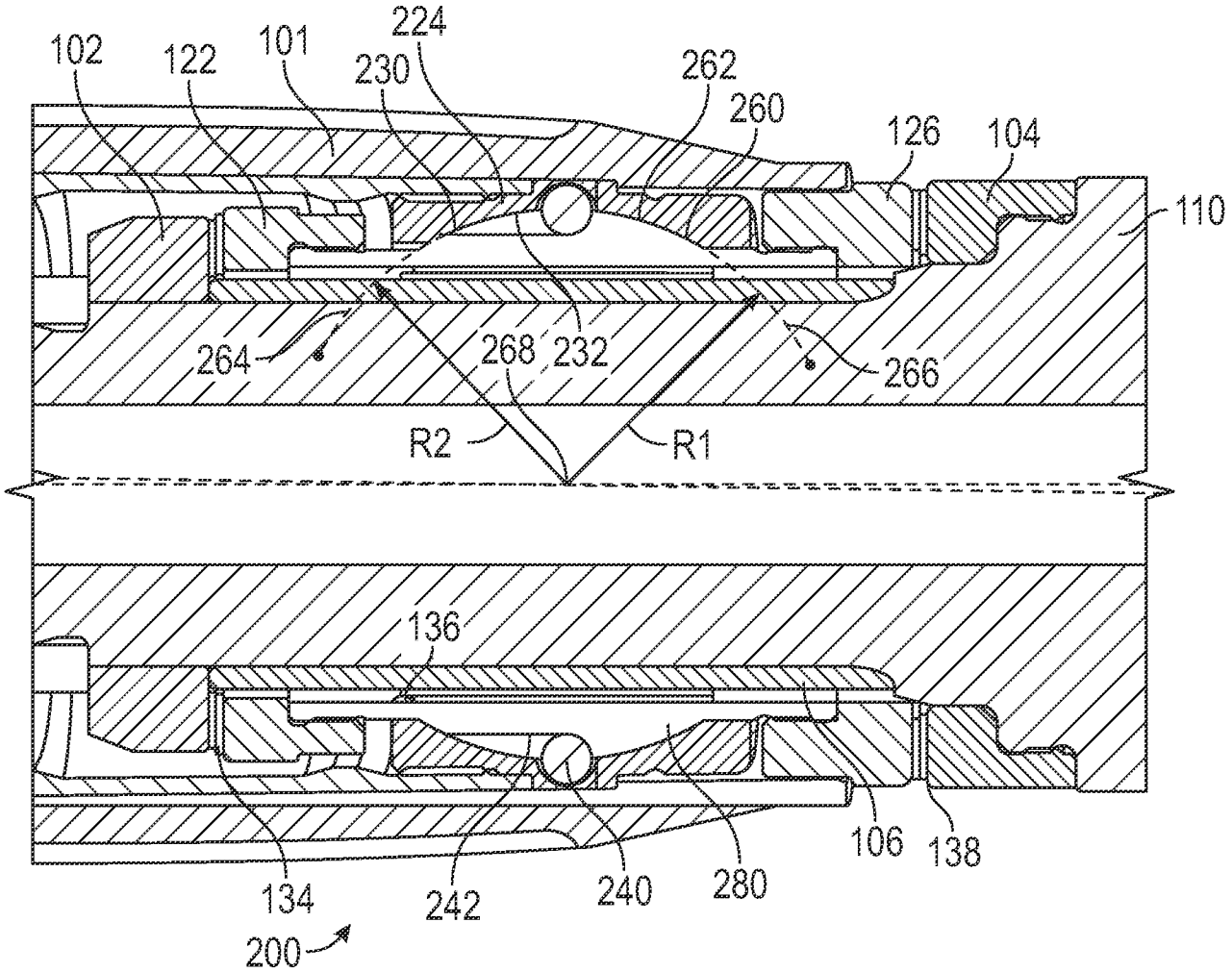
FIG. 11 illustrates another embodiment of a self-aligning bearing in accordance with the present disclosure.

Referring to FIG. 11, there is illustrated an alternate embodiment of a self-aligning bearing assembly 200 for directionally drilling a borehole in a subterranean formation. The bearing assembly 200 includes an upper dynamic thrust bearing 102, a lower dynamic thrust bearing 104, and a dynamic radial bearing 106. The bearing assembly 200 is connected to a drive shaft 110. The upper dynamic thrust bearing 102, the lower dynamic thrust bearing 104, and the dynamic radial bearing 106 are rotationally fixed to drive shaft 110, so that the upper dynamic thrust bearing 102, the lower dynamic thrust bearing 104, and the dynamic radial bearing 106 rotate with the same rotational velocity as the drive shaft 110 about the length axis of the drive shaft 110. The bearing assembly 200 includes a self-alignment assembly that reduces the detrimental effects on the bearings 102, 104, 106 from deflection of a drive shaft 110 relative to a tool housing 101. In one non-limiting embodiment, the self-alignment assembly includes a plurality of interconnected members that allow an amount of articulation; i.e., ability to pivot or tilt relative to one another. This articulation allows the self-alignment assembly to passively accommodate the forces of the drilling process. The members can include an upper static thrust bearing 122, a carrier ring 224, and a lower static thrust bearing 126. Upper dynamic thrust bearing 102 and upper static thrust bearing 122 as well as lower dynamic thrust bearing 104 and lower static thrust bearing 126 comprise opposing sliding surfaces at least portions of which are plane and perpendicular to the longitudinal axis of the drive shaft 110. Similarly, radial bearing 106 and bearing carrier 280 have opposing sliding surfaces at least portions of which are cylindrical about the longitudinal axis of the drive shaft 110 and, thus, in at least one cross section perpendicular to the longitudinal axis of the drive shaft 110 and comprising the radial bearing 106, perpendicular to a line that is perpendicular to the longitudinal axis of the drive shaft 110. The upper static thrust bearing 122, the lower static thrust bearing 126, and the bearing carrier 280 are rotationally fixed to tool housing 101 as described in more detail below, so that the upper static thrust bearing 122, the lower static thrust bearing 126, and the bearing carrier 280 rotate with the same rotational velocity as the tool housing 101 about the length axis of the housing 101. The bearing carrier 280 includes an inner contoured surface 260 that contacts an outer contoured surface 262 of the lower static thrust bearing 126. Likewise, the upper static thrust bearing 122 may have an inner contoured surface 230 that contacts an outer contoured surface 232 of the bearing carrier 280. Upper static thrust bearing 122 and lower static thrust bearing 126 may be fixedly connected, e.g. by threads, welds, adhesive attachments, anti-rotation elements, or similar. Likewise, tool housing 101 and bearing carrier 280 may be fixedly connected, e.g. by threads, welds, adhesive attachments, anti-rotation elements, or similar. Alternatively, upper static thrust bearing 122 and lower static thrust bearing 126 may be one integral part, and/or tool housing 101 and bearing carrier 280 may be one integral part. Further, at least one of upper static thrust bearing 122, lower static thrust bearing 126, and bearing carrier 280 may comprise two or more parts (not shown) that are connected, e.g. connected by threads, welds, adhesive attachments, anti-rotation elements, or similar, in a way that prevents relative rotation and/or linear movement of the two or more parts. A bearing assembly 100 with one integral part comprising upper static thrust bearing 122 and lower static thrust bearing 126 and/or tool housing 101 and bearing carrier 280 may be made, e.g. by additive manufacturing such as but not limited to 3D printing. Alternatively or in addition, bearing assembly 200 may comprise integral half shells (not shown) comprising two or more of the parts shown in FIG. 11 and suited to assemble at least parts of bearing assembly 200.

Still referring to FIG. 11, there is shown contoured surfaces 230, 232, 260, and 262. In aspects, the arrangement shown in FIG. 11 is similar to the arrangement shown in FIG. 2A and FIG. 2B. The combined axial and radial bearing assembly displayed in FIG. 11 uses contoured surfaces 230, 232, 260, 262 at least partially contoured along spheres 264 and 266 having radii $R_1$ and $R_2$ that are equal or similar in dimension. For example, in one arrangement, the contoured surfaces 230, 232 are aligned with a surface defined by sphere 264 around a center point 268 and the contoured surfaces 260, 262 are aligned with a surface defined by sphere 266 with the same center point 268. The spheres 264 and 266 have equal or at least similar diameters and share the common center point 268. Comparably, in FIGS. 2A and 2B, the carrier ring 124 is carrying both contoured surfaces 132 and 160 at the uphole side of the center 168. In this arrangement, spheres 164 and 166 define the width of carrier ring 124, which is also defined by a minimum width as a function of the load carrying capacity, therefore defining a minimum difference between sphere sizes 164 and 166. Alternatively for the arrangement shown in FIG. 11, the spheres 264 and 266 can be of same or similar size when the corresponding surfaces 230/232 and 260/262 are located on either side of the center point 268. For example, surfaces 230/232 corresponding to sphere 264 are located uphole of the center point 268 while surfaces 260/262 corresponding to sphere 266 are located downhole the center point 268. The surfaces 230, 232 and 260, 262 are arranged and positioned to allow the lower static thrust bearing 126 and the upper static thrust bearing 122 to rotate or pivot in a ball joint fashion about an axis perpendicular to the length axis of drive shaft 110. During this motion, there is relative sliding motion between the surfaces 230 and 232 as well as between surfaces 260 and 262. Surfaces 260 and 262 account for axial and radial bearing loads directed at least partially opposite to those directed into surfaces 230, 232. Since spherical surface 230, 232 and 260, 262 share a common center point 268, a point of bearing tilt is defined at the common center point 268.

In the arrangement of FIG. 11, there are a plurality of areas through which torque is frictionally transferred from the drive shaft 110 into the bearing assembly 200. The plurality of areas through which toque is frictionally transferred include an upper thrust area 134 between the upper dynamic thrust bearing 102 and the upper static thrust bearing 122, an inner bearing area 136 between the radial bearing 106 and the static bearing carrier 280, and a lower thrust area 138 between lower dynamic thrust bearing 104 and the lower static thrust bearing 126. In the displayed assembly, the upper thrust area 134 transfers torque from the drive shaft 110 into the bearing assembly 120 by friction that is created of downward directed loads 170 (FIG. 2A), caused by operations such as back-reaming, pulling or hydraulic thrust caused by the rotary power device 38 (FIG. 1). The lower thrust area 138 transfers torque from the drive shaft 110 into the bearing assembly 120 by friction that is created of upward directed loads 172 (FIG. 2A) mainly caused by the drilling weight, sometimes also referred to as weight on bit (WOB).

Figure 12:
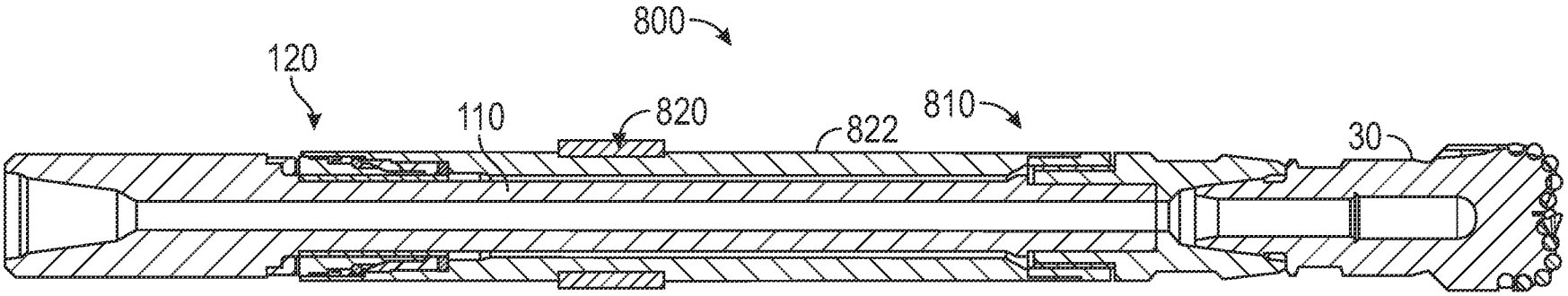
FIG. 12 illustrates a downhole steerable drilling assembly that may use the teachings of the present disclosure.

Still referring to FIG. 11, anti-rotation elements 240 are positioned between the carrier ring 224 and the static bearing carrier 280 to prevent relative rotational movement about the longitudinal drive shaft axis between static bearing carrier 280 and carrier ring 224 and ultimately between upper static thrust bearing 122, static bearing carrier 280, carrier ring 224, and tool housing 101. Anti-rotation elements 240 may prevent relative rotation (e.g. relative rotation induced by torque that is frictionally transferred) about a first axis but may allow relative rotation about a second axis. For example, anti-rotation elements 240 may prevent relative rotation about the longitudinal drive shaft axis while allowing relative rotation about an axis that is perpendicular to the longitudinal drive shaft axis. For instance, the anti-rotation elements 240 may be disposed in elongated slots 242 formed in either or both of the inner and outer contoured surfaces of static bearing carrier 280 and carrier ring 224 and can be positioned at the surfaces of spheres 264, 266 and in a plane perpendicular to the longitudinal drive shaft axis that includes the common center point 268. The slots 242 are elongated parallel with the longitudinal axis of the drive shaft. The anti-rotation elements 240 have the freedom to move along the elongated slots 242, which allows the upper static thrust bearing 122 and the static bearing carrier 280 to incline or tilt with respect to carrier ring 224 about an axis that is perpendicular to the longitudinal drive shaft axis in a desired direction. This arrangement locks the three translational degrees of freedom and the rolling degree of freedom (about the longitudinal tool axis) of the bearing assembly 200, while keeping the pitching and yawing degree of the drive shaft 110 free in any direction about an axis that is perpendicular to the longitudinal drive shaft axis (omni-directional tilt) and the rotating degree of the drive shaft 110 about the longitudinal drive shaft axis free. In one non-limiting embodiment, the anti-rotation element 240 may be rigid bodies, such as pins, keys, balls, or cylinders, such as metal pins, keys, balls or cylinders that physically contact the carrier ring 124 and the static bearing carrier 280. In another non-limiting embodiment anti-rotation elements 240 can alternatively be flexible members that have flexibility to deform along the elongated slots 242, hence allowing the upper static thrust bearing 122 and the static bearing carrier 280 to incline or tilt even without sliding movement of the anti-rotation elements 240 with respect to the upper static thrust bearing 122 and the static bearing carrier 280. Referring to FIG. 12, there is shown another bottomhole assembly 800 that uses a sleeve 822 that rotates at a speed that is different to the rotational speed of the drive shaft 110 that drives the drill bit 30. For example, sleeve 822 may rotate significantly slower than the inner drive shaft 110 and the drill bit 30 or may rotate not at all. E.g. for a rotary steerable system, the upper bearing may be a self-aligning combined axial/radial bearing 120 as described previously while the lower bearing 810 is a non self-aligning radial bearing. A deflection of the sleeve 822 with respect to the inner shaft is created by pads 820 on the sleeve 822 that may be actuated and pressed against the borehole wall to steer the BHA 800. One or more stabilizers (not shown) uphole of the combine axial/radial bearing 120 may support the creation of the deflection.

While the foregoing disclosure is directed to the one mode embodiments of the disclosure, various modifications will be apparent to those skilled in the art. For example, while most of the embodiments are illustrated with respect to a motor or a tilted drive shaft, it is obvious that in other embodiments, the invention can advantageously be used with respect to the bearings of a rotary steerable system. It is intended that all variations within the scope of the appended claims be embraced by the foregoing disclosure.

What is claimed is:

1. An apparatus for use in a wellbore in a subterranean formation, comprising:

a rotary power device;

a drill string section adjacent the rotary power device;

a drive shaft disposed in the drill string section and configured to: (i) transmit rotary power from the rotary power device to a drill bit to rotate the drill bit and (ii) rotate relative to the drill string section;

a bearing assembly connected to the drive shaft, the bearing assembly including at least one axial bearing and at least one radial bearing, wherein at least one of the at least one radial bearing and the at least one axial bearing includes opposing surfaces; and an alignment assembly, the alignment assembly having a first alignment member and a second alignment member slidingly engaging one another to allow the opposing surfaces to tilt relative to the drill string section.

2. The apparatus of claim 1, wherein the axial bearing and the radial bearing tilt with the drive shaft through the same angle.

3. The apparatus of claim 1, wherein the drive shaft has a first longitudinal axis and the bearing assembly allows for rotation of the drive shaft about the first longitudinal axis and the alignment assembly allows for a tilt of the drive shaft about an axis perpendicular to the first longitudinal axis.

4. The apparatus of claim 1, wherein the first alignment member has a first surface and the second alignment member has a second surface in contact with the first surface.

5. The apparatus of claim 4, wherein at least one of a portion of the first surface and a portion of the second surface are defined by a first sphere.

6. The apparatus of claim 5, wherein the alignment assembly includes a third alignment member having a third surface and a fourth alignment member having a fourth surface in contact with the third surface.

7. The apparatus of claim 6, wherein the drive shaft has a first longitudinal axis, wherein the second alignment member and the third alignment member are connected by a first connection element that limits the rotation between the second and third alignment member about the first longitudinal axis or are one integral part; or wherein the first alignment member and the fourth alignment member are connected by a second connection element that limits the rotation between the first and fourth alignment member about the first longitudinal axis or are one integral part.

8. The apparatus of claim 6, wherein the at least one of the axial bearing and the radial bearing tilt with the drive shaft through the same angle.

9. The apparatus of claim 6, wherein at least one of a portion of the third surface and a portion of the fourth surface are defined by a second sphere, wherein the first sphere and the second sphere have a common center point.

10. The apparatus of claim 1, wherein the drive shaft has a first longitudinal axis, wherein the drill string section has a second longitudinal axis, and further comprising:

at least one eccentricity member associated with the bearing assembly, the at least one eccentricity member tilting the first longitudinal axis relative to the second longitudinal axis a predetermined amount.

11. The apparatus of claim 10, wherein the at least one eccentricity member is adjustable.

12. The apparatus of claim 10, wherein the at least one eccentricity member includes a first and a second eccentricity member, the first and the second eccentricity members being movable relative to one another and tilting the second longitudinal axis between a first value and a second value relative to the first longitudinal axis.

13. A method for performing an operation in a wellbore in a subterranean formation, comprising:

positioning a drive shaft in a drill string section and adjacent to a rotary power device, the drive shaft configured to (i) transmit rotary power from the rotary power device to a drill bit to rotate the drill bit and (ii) rotate relative to the drill string section;

connecting a bearing assembly to the drive shaft using an alignment assembly, the bearing assembly including at least one axial bearing and at least one radial bearing, wherein at least one of the at least one radial bearing and the at least one axial bearing includes opposing surfaces, the alignment assembly having a first alignment member and a second alignment member; and allowing the opposing surfaces to tilt relative to the drill string section using the alignment assembly by having the first alignment member and the second alignment member slidingly engage one another.

14. The method of claim 13, wherein the drive shaft has a first longitudinal axis, and the drill string section has a second longitudinal axis, and further comprising:

tilting the second longitudinal axis relative to the first longitudinal axis a predetermined amount using at least one eccentricity member.

15. The method of claim 14, further comprising adjusting the at least one eccentricity member to change an amount of tilt of the second longitudinal axis relative to the first longitudinal axis.

16. An apparatus for use in a wellbore in a subterranean formation, comprising:

a rotary power device;

a drill string section;

a drive shaft disposed in the drill string section, the drive shaft configured to; (i) transmit rotary power from the rotary power device to a drill bit to rotate the drill bit and (ii) rotate relative to the drill string section;

a bearing assembly connected to the drive shaft, the bearing assembly including at least one axial bearing and at least one radial bearing; and an alignment assembly connecting the bearing assembly to the drill string section, the alignment assembly having a first alignment member and a second alignment member slidingly engaging one another to allow at least a portion of the drive shaft to tilt relative to the drill string section, and wherein the alignment assembly includes a third alignment member having a third surface and a fourth alignment member having a fourth surface in contact with the third surface.

* * * * *